US005485708A

United States Patent [19]

Johnson

[11] Patent Number: 5,485,708

[45] Date of Patent: Jan. 23, 1996

[54] EXTENSION JAMB KIT

[76] Inventor: Flint S. Johnson, 645 5th Ave. South, South St. Paul, Minn. 55075

[21] Appl. No.: 312,398

[22] Filed: Sep. 26, 1994

[51] Int. Cl.[6] ..... E04B 1/00

[52] U.S. Cl. ..... 52/745.16; 52/212; 52/656.4

[58] Field of Search ..... 52/718.02, 718.01, 52/212, 204.54, 656.4, 656.5, 656.2, 582.2, 584.1, 745.16, 745.15; 49/505

[56] References Cited

U.S. PATENT DOCUMENTS 3,204,586 9/1965 Marsh, Jr. ..... 52/584.1

4,965,970 10/1990 Nania ..... 52/584.1 X

*Primary Examiner*—Lanna Mai

*Attorney, Agent, or Firm*—Jacobson and Johnson

[57] ABSTRACT

An extension jamb for rapid attachment directly to a frame to form an extension on the frame, with the extension jamb having a top surface for engaging a frame, with the extension jamb characterized by having a transverse elongated recess therein and an opening in the extension jamb, with the opening temporarily holding a fastener in a ready-to-use condition, and the opening having a central axis substantially parallel to the top surface to enable one to drive a fastener through a portion of the extension jamb and into the frame to enable securing the extension jamb to the window frame.

13 Claims, 1 Drawing Sheet

EXTENSION JAMB KIT

FIELD OF THE INVENTION

This invention r dates generally to extension jambs for building structures such as doors, windows and the like and, more specifically, to a ready-to-use quick-attachment extension jamb which can be removably attached with a conventional carpenter's tool.

BACKGROUND OF THE INVENTION

The concept of extension jambs for window and door frames is old in the art. Typically, extension jambs are used to extend the window or door frame to accommodate different wall thicknesses in a building. Frequently, the extension jambs are toe-nailed onto the window frame or, if not toe-nailed, attached through a hole drilled laterally through the entire extension jamb and a nail driven through the extension jamb to hold it in place. Both of these procedures are disadvantageous because they are not only time-consuming but the process can split or damage the extension jamb. In addition, nailing makes it difficult, if not impossible, to remove the extension jamb without damaging either the jamb or the frame if building construction requires removal of the extension.

The present invention improves the procedure by providing an extension jamb that caries a fastener in a ready-to-use, out of the way position to enable an on-site worker to attach the extension jambs to building frames quickly, such as doors, window frames and the like.

SUMMARY OF THE INVENTION

Briefly, the invention comprises and extension jamb kit for quickly securing an extension jamb directly to a building frame to form an extension on the frame. The extension jamb has a top surface and a surface for engaging a frame, with the extension jamb characterized by a transverse elongated recess therein for holding a fastener in a ready-to use condition and an opening in the extension jamb with the opening having sidewalls for temporarily holding a fastener in a ready-to-use condition. The opening has a central axis substantially parallel to the top surface which acts as guide for the fastener, enabling driving the fastener into the frame to secure the extension jamb to the frame.

DESCRIPTION OF THE PREFERRED EMBODIMENT

Figure 1:
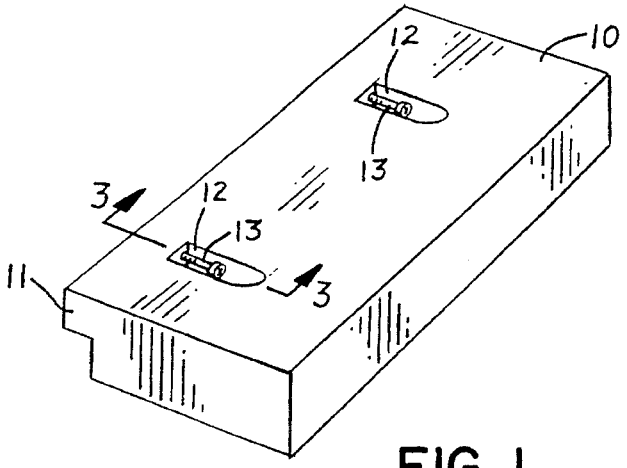
FIG. 1 shows a perspective view of an extension jamb with a quick-attachment means.

FIG. 1 reference numeral 10 generally identifies an extension jamb having a tongue 11 for engaging a notch or mating groove in a window frame or the like. Located and recessed in the top surface of jamb 10 is a pair of elongated recesses 12, each having a screw fastener 13 temporarily held therein. Recesses 12 are located in surface 10*a* and are spaced from opposite sides of extension jamb 10 to minimize dislodgment of screw fasteners located therein during handling of the extension jambs.

Figure 2:
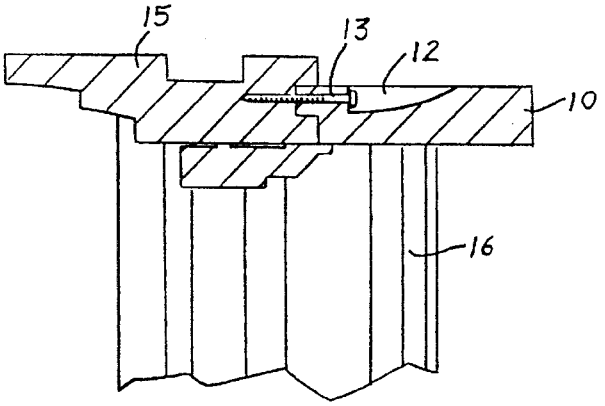
FIG. 2 shows a cross-sectional view of the extension jamb fastened to a window frame.

FIG. 2 reference numeral 15 identifies a building frame with a side member 16. The building frame can be a door or a window frame. It is shown with extension jamb 10 having tongue 11 located in grove 17 and secured to member 15 by screw fastener 13. It is noted that the screw fastener 13 extends through the tongue and into the body of member 15 to hold extension jamb 10 in position.

Figure 3:
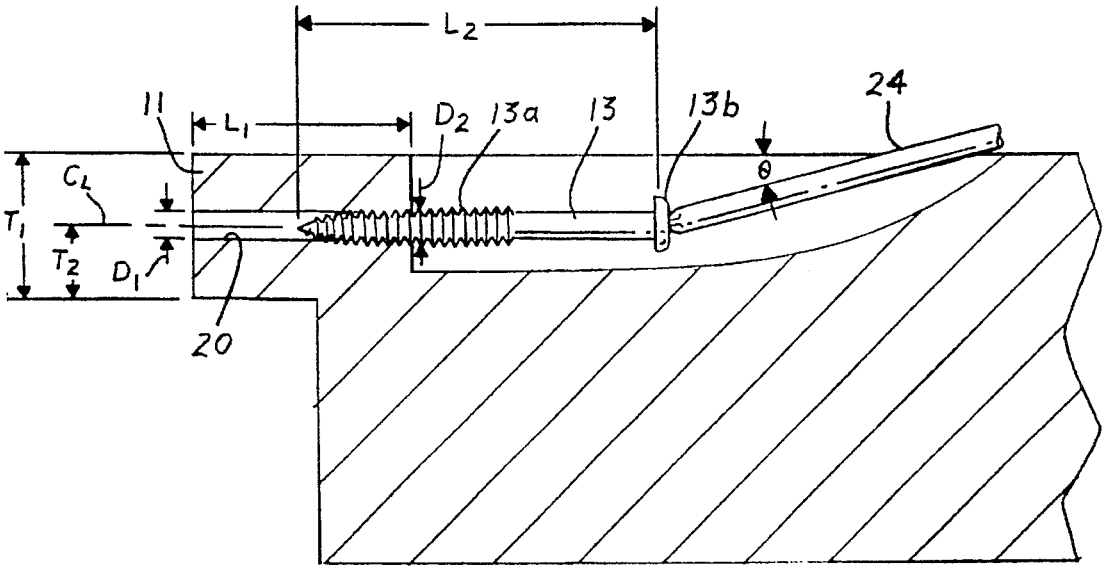
FIG. 3 shows a sectional view taken along lines 3—3 of FIG. 1.

To appreciate the invention, refer to FIG. 3 which shows the extension jamb 10 in cross section. Recess 12 is located in extension jamb 10 and extends below top surface 10*a* of extension jamb 10. Recess 12 is elongated and contains a bottom 12*b* and an end wall 12*a* with a cylindrical opening 20 extending through tongue 11. Opening 20 has a diameter $D_1$. Located within opening 20 is screw fastener 13 having a threaded section 13*a* which has a diameter $D_2$ which is sufficiently large to form an interference fit with sidewalls 20*a*. The engagement of threads 13*a* with the sidewall of opening 20 is sufficiently strong so that one can hold screw fastener 13 in extension jamb 10 during the normal handling of jamb 10 prior to insertion of the extension jamb into the frame.

FIG. 1 shows that screw fasteners 13 are maintained and held in a ready-to-use position within elongated recesses 12 by the coaction of the threaded section 13*a* and sidewalls 20*a* of opening 20. With the screw fastener held in the recess, the extension jambs can be handled without accidentally knocking the screw fasteners from the extension jamb. To prevent splitting of tongue 11, opening 20 is sufficiently large so that driving screw fastener 13 through opening 20 does not produce sufficient radial force to split tongue 11. Therefore, the range of engagement between sidewalls 20*a* and screw fastener 13 is sufficient to prevent screw fastener 13 from falling out during normal handling of jamb 10 and has insufficient diametrical differences to prevent driving screw fastener through opening 20 without rupturing tongue 11.

A centerline designated by $C_1$ extends through opening 20. It is generally in line with axis of screw fastener 13 and also substantially parallel with surface 10*a*. The thickness of extension member 11 is designated by $T_1$; opening 20 is indicated as approximately in the middle of tongue 11 and is designated by $T_2$ The length of the screw is designated by $L_2$, and the length of the dimension of the opening in the tongue is designated by $L_1$. It is noted that $L_2$ is longer than $L_1$ so that screwing fastener 13 inward engages and holds in frame member 15.

Figure 4:
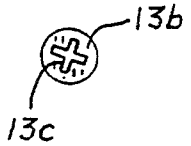
FIG. 4 shows an end view of the fastener for holding the extension jamb to a window frame.

FIG. 4 shows a rear-view of screw fastener 13 for use in the present invention. The head shown is a closed cavity head such as a Phillips-type retaining head 13*b* having cross slots 13*c*. The purpose of having a closed or cavity type head is that the the slots in the head 13*b* do not extend completely across head 13, so that one can insert an end of a screwdriver blade 24 at an angle as shown in FIG. 2 without having the end of the screwdriver slip out of head 13*b*. That is, the angle Ø is sufficiently small so that the head of the screwdriver won't slip and one can rotate screwdriver blade 24 and screw fastener 13 without having the head of screwdriver 24 slip out of slots 13*c*. Consequently, one can quickly drive screw fastener 13 through opening 20 and into the flame member 15 with a power screwdriver or the like. Opening 20 acts as a guide to maintain screw fastener 13 in alignment with axis $C_L$, so that even though the screw driver 24 is located at a slight angle to the axis of the screw fastener, one can drive the screw fastener through tongue 11 and into frame 15 without splitting or damaging tongue 11. By maintaining the screw fastener in a parallel position, one is assured that the screw engages frame 15 without accidentally extending out the side of frame 15.

Thus, the present invention provides a ready-to-use extension jamb 10 for attachment directly to a building frame 15 to form an extension on the building frame with the extension jamb characterized having a top surface 10*a* with a recess 12 therein and a tongue 11 for engaging a groove 17 in the building frame. The tongue has an opening 20 therein communicating with recess 12, with screw fastener 13 temporarily secured within opening 20 to enable one to handle the extension jamb without disturbing the fastener to ensure that fastener 13 remains in a ready-to-use position in the recess, so one can quickly drive the fastener through tongue 11 and into building frame 15 to secure the extension jamb to the building frame with the fastener extending through tongue 11 and into building frame 15. By providing screw fastener 13 with a closed head, as shown in in FIG. 4, one can insert the tip of screwdriver 24 into screw fastener head 13*b* at a slight angle and still be able to rotate the fastener to drive the fastener into the building frame. As a result, the screw fastener can be held in the recess and still be driven in the tongue in a path parallel to the top surface 10*a* of extension jamb 10. While the invention is shown win a tongue as a surface projection the present invention can also be used with flat surfaces on the frame and on the extension jamb that abut against each other without the interfitting of a tongue and grove.

I claim:

1. A ready-to-use extension jamb, said extension jamb having a one end with an opening therein for abutment and engagement to a building frame and an opposite free end with no opening therein, said extension jamb having a top surface with a recess therein, said extension jamb one end engageable with the building frame with the opposite free end cantilevreable from said building frame extension jamb having a further opening therein communicating with the recess, with; and a fastener temporarily secured in a ready to apply position within the opening in the extension jamb by engagement between the fastener and the extension jamb said fastener located in the recess and below said top surface, so that one can handle the extension jamb without disturbing the fastener to enable the fastener to remain in a ready-to-use position in the recess so one can quickly drive the fastener through a portion of the extension jamb and into the building frame to secure the extension jamb to the building frame with the fastener engaging the one end and extending into the building frame to support the extension jamb in a cantilever fashion therefrom.

2. The extension jamb of claim 1 wherein the extension jamb has a generally rectangular shape and the fastener is held in the opening in the extension jamb in a ready-to-apply position by frictional engagement of the fastener with the extension jamb.

3. The extension jamb of claim 1 including a tongue extending from said one end with the opening extending through a middle portion of the tongue.

4.The extension jamb of claim 3 wherein the fastener is a screw fastener and the opening in the extension jamb extends completely through a portion of the extension jamb and is sufficiently large so that driving said screw fastener through the opening in the extension jamb does not split the tongue.

5. The extension jamb of claim 2 wherein the fastener has a closed head to retain a tool tip therein during driving of the fastener into the building frame.

6. The extension jamb of claim 5 wherein the recess in said extension jamb is sufficiently long so that a fastener located in said extension jamb can be driven into the building frame by a driver located at a slight angle to the central axis of the opening in the tongue.

7. The extension jamb of claim 6 wherein the closed head is a Phillips head.

8. The extension jamb of claim 5 including at least two fasteners and two openings located in said extension jamb.

9. The extension jamb of claim 5 wherein the recess is elongated and extends partially across the extension jamb.

10. The extension jamb of claim 5 wherein the recess has a tapered end.

11. The extension jamb of claim 1 wherein the recess is sufficiently deep to maintain a head of the fastener located therein below the top surface of the extension jamb.

12. In combination;

a building frame including a jamb; and a ready-to-use extension jamb secured directly to the jamb on the building frame to form an extension that extends laterally away from the building frame, said extension jamb having a top surface with a recess therein and a one end for engaging an edge in the building frame, and a fastener frictionally engaged in the recess in out of the way position without the fastener producing from the top surface, said fastener securing the one end of the extension jamb to the jamb of the building frame in a cantilevered manner.

13. The method of fastening a one end of an extension jamb to a building frame while leaving an opposite end extending therefrom in a cantilevered fashion comprising the steps of:

forming a tongue on one end of e extension jamb:

forming a recess in a portion of an extension jamb having a tongue forming an opening in the tongue of the extension jamb, such that the recess in communication with the opening;

inserting a fastener having sufficient frictional engagement with a sidewall of the opening to maintain the fastener within the opening and the recess during handling of the extension jamb;

placing said tongue of the extension jamb against a jamb of the building frame;

placing a tool at an acute angle with respect to the fastener; and driving the fastener until the fastener extends through the extension jamb and into the building frame to thereby secure the extension jamb to the building frame.

* * * * *